US006178722B1

(12) United States Patent
McMahon

(10) Patent No.: US 6,178,722 B1
(45) Date of Patent: Jan. 30, 2001

(54) APPLICATION SYSTEM FOR SLIDERS AT FORM-FILL-SEAL MACHINE

(75) Inventor: Michael J. McMahon, Palatine, IL (US)

(73) Assignee: Illinois Tool Works, Inc., Glenview, IL (US)

( * ) Notice: Under 35 U.S.C. 154(b), the term of this patent shall be extended for 0 days.

(21) Appl. No.: 09/131,268

(22) Filed: Aug. 7, 1998

Related U.S. Application Data

(63) Continuation-in-part of application No. 09/093,111, filed on Jun. 8, 1998, now Pat. No. 5,953,796.

(51) Int. Cl.[7] ..... B65B 9/20; B65B 61/18

(52) U.S. Cl. ..... 53/412; 451/133.4; 451/139.2; 451/551; 451/552

(58) Field of Search ..... 53/412, 451, 133.4, 53/139.2, 551, 552; 493/213, 215, 927

(56) References Cited

U.S. PATENT DOCUMENTS 4,241,865 * 12/1980 Ferrell ..... 53/133.4
4,534,752 * 8/1985 Ferrell ..... 493/213
4,581,006 * 4/1986 Hughues ..... 493/213
4,620,320 * 10/1986 Sullivan ..... 493/213
4,894,975 * 1/1990 Ausnit ..... 53/139.2
5,561,966 * 10/1996 English ..... 53/133.4

FOREIGN PATENT DOCUMENTS

2085519 * 4/1982 (GB) ..... 53/133.4
WO 99/24325 5/1999 (WO) .

* cited by examiner

*Primary Examiner*—John Sipos
(74) *Attorney, Agent, or Firm*—Pitney, Hardin, Kipp & Szuch LLP

(57) ABSTRACT

A method and apparatus for manufacturing reclosable bags having slide zippers on a form-fill-seal machine is provided. In a first embodiment the sliders are preapplied to the zipper and the bags are made using conventional form-fill-seal techniques. In a second embodiment a coil of sliders is fed into the form-fill-seal machine where the sliders are applied to the zippers by an insertor mechanism. In a third embodiment a magazine of individual or connected sliders is used to feed a slider insertor mechanism which then applies the sliders to the interlocked zippers. In a fourth embodiment bulk sliders are introduced into a vibratory feeding bowl which then orients and feeds the sliders to the slider insertor mechanism.

9 Claims, 8 Drawing Sheets

APPLICATION SYSTEM FOR SLIDERS AT FORM-FILL-SEAL MACHINE

CROSS REFERENCE TO RELATED APPLICATIONS

This application is a continuation-in-part (CIP) of Ser. No. 09/093,111, filed Jun. 8, 1998 now U.S. Pat. No. 5,953,796, the disclosure of which is incorporated herein by reference.

BACKGROUND OF THE INVENTION

1. Field of the Invention

The present invention relates to reclosable plastic bags having slide zippers. More particularly, the present invention relates to a method and apparatus for making slide-zippered reclosable bags on form-fill-seal (FFS) machines.

2. Description of the Prior Art

Methods and apparatus for manufacturing reclosable plastic bags on FFS machines using reclosable zippers are well-known in the art. These prior art methods and apparatus, however, are limited to interlocking zippers which are directly opened and closed by the hands of the bag user and are not designed for the utilization of a slider for opening and closing the zipper.

The method and apparatus of the present invention, on the other hand, relate specifically to reclosable bags having a slide zipper. Reclosable bags having slide zippers are generally more desirable to consumers than bags which have traditional interlocking zippers since it is much easier for the user to open and close bags having a slide zipper. It is thus commercially highly desirable and advantageous to provide a method of and apparatus for manufacturing slide-zippered reclosable plastic bags in a continuous, automated process.

Slide zippers for use with plastic bags are well known in the reclosable fastener art. Examples of conventional slide zippers can be found in U.S. Pat. Nos. 5,007,143, 5,008,971, 5,131,121 and 5,664,299. Typical slide zippers comprise a plastic zipper having two interlocking profiles and a slider for opening and closing the zipper. The slider straddles the zipper and has a separator at one end which is inserted between the profiles in order to force them apart, that is, the separator plows between the profiles forcing them to disengage. The other end of the slider is sufficiently narrow to be able to close the zipper.

Recently, a new type of slider zipper has been developed which, as discussed fully below, improves on prior art slide zippers and includes features which facilitate the manufacture of bags in automated form fill processes.

It is therefore the object of the present invention to provide a unique and novel method and apparatus for making slide-zippered bags on an FFS machine.

SUMMARY OF THE INVENTION

The present invention is, in two aspects, a method of making slide-zippered plastic bags on an FFS machine and an apparatus for making slide-zippered plastic bags on an FFS machine.

In a first embodiment of the present invention, the slider is preapplied to the zipper at the zipper manufacturing site. Then, at the FFS site the plastic bags are made on the FFS machine utilizing conventional and well-known FFS technology, such as disclosed in U.S. Pat. No. 4,894,975. To facilitate guiding and alignment of the zipper, the zipper is provided with guiding flanges.

In a second embodiment of the present invention, the plastic bags are made on the FFS machine and the zipper is attached to the bags in the conventional manner. A coil of sliders, each slider being connected to its two adjacent sliders, is used to feed the sliders into the FFS machine, which sliders are then applied by a slider insertor mechanism to the zipper. In a slight variation of this embodiment, the slider insertor mechanism can be positioned to apply the sliders to the zipper before the zipper is fed into the FFS machine for sealing to the plastic bags.

In a third embodiment of the present invention, the plastic bags are made on the FFS machine and the zipper is attached to the bags in the conventional manner. A magazine of individual or interconnected sliders is used to feed a slider insertor mechanism which applies the sliders to the zipper. In a slight variation of this embodiment, the slider insertor mechanism can be positioned to apply the sliders to the zipper before the zipper is fed into the FFS machine for sealing to the plastic bags.

In a fourth embodiment of the present invention, the plastic bags are made on the FFS machine and the zipper is attached to the bags in the conventional manner. Bulk sliders are introduced into a vibratory feeding bowl which orients and feeds the sliders to the slider insertor mechanism which applies the sliders to the zipper. In a slight variation of this embodiment, the slider insertor mechanism can be positioned to apply the sliders to the zipper before the zipper is fed into the FFS machine for sealing to the plastic bags.

The present invention will now be described in more complete detail with reference being made to the figures identified below wherein the same numerals represent identical elements.

DETAILED DESCRIPTION OF THE PREFERRED EMBODIMENT

Figure 1:
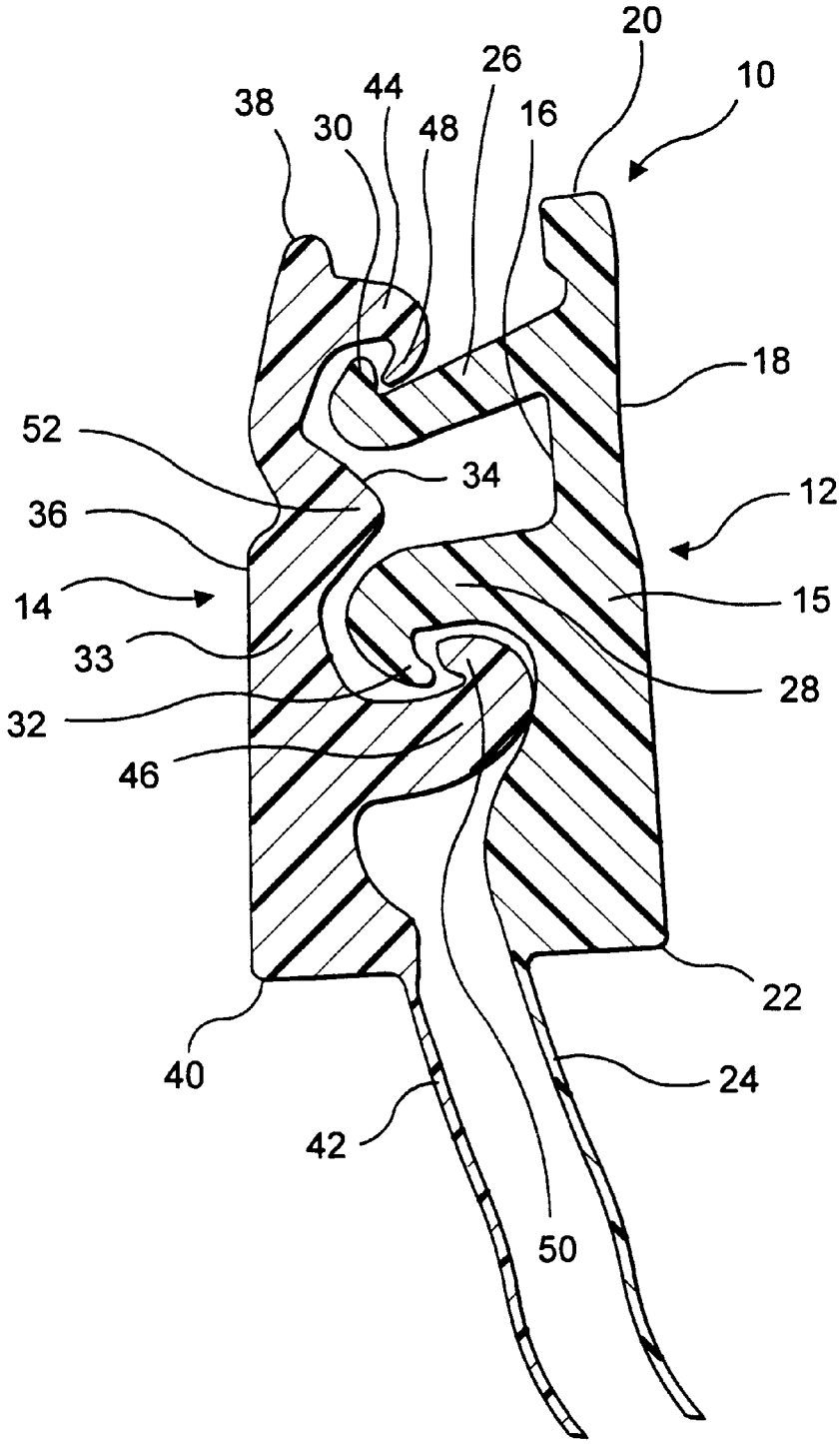
FIG. 1 is a cross sectional view of an interlockable zipper in accordance with the present invention.
Figure 2:
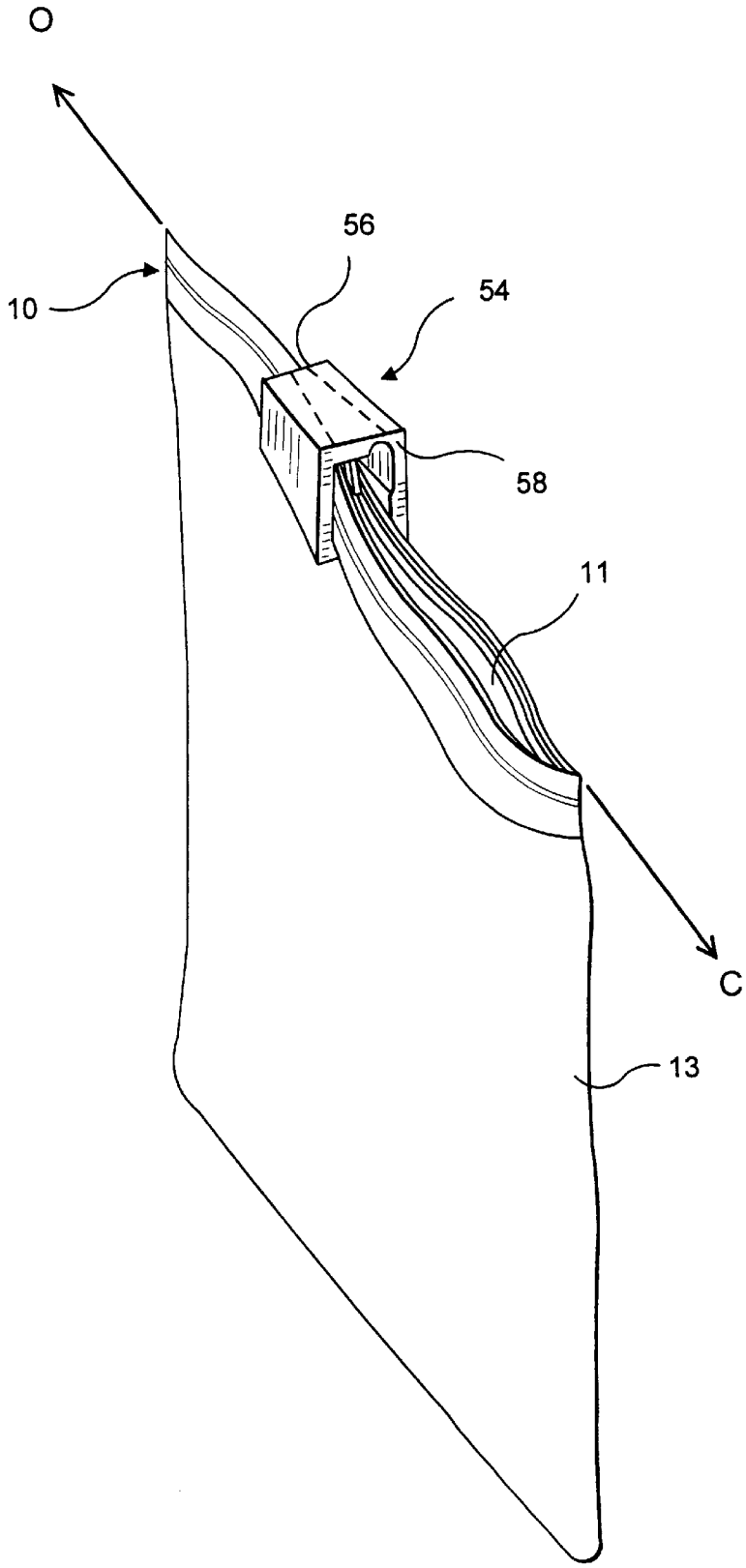
FIG. 2 is a perspective view of a slide zipper in accordance with the present invention attached to a plastic bag.

FIG. 1 shows a cross sectional view of interlockable zipper 10 which may be used to practice the present invention. The zipper 10 is formed of a resilient plastic material such as polyethylene and comprises a first profile 12 and a second profile 14. The zipper 10 is disposable across the mouth 11 of a plastic bag 13, as shown in FIG. 2. For purposes of this description the bag 13 will be assumed to be oriented with its mouth 11 on top as depicted in FIG. 2.

The first profile 12 has a base 15 having an inner side 16 and outer side 18, a top portion 20, a bottom surface 22, a flange 24, a top hooked arm 26 and a bottom hooked arm 28.

The top hooked arm 26 and the bottom hooked arm 28 of the first profile 12 have hooked ends 30 and 32 which are directed away from each other. Thus, the hooked end 30 of top hooked arm 26 is oriented upwardly while the hooked end 32 of the bottom hooked arm 28 is oriented downwardly. As is clear from FIG. 1, the top hooked arm 26 is longer and thinner than the bottom hooked arm 28. The top hooked arm 26 is thus more flexible than the bottom hooked arm 28, thereby providing for ease of opening of the zipper 10 from the outside of a bag employing the zipper 10. Conversely, because bottom hooked arm 28 is shorter and thicker than top hooked arm 26, and thus less flexible, the internal opening force will be greater.

The second profile 14 likewise has a base 33 having an inner side 34 and an outer side 36, a top portion 38, a bottom surface 40, a flange 42, a top hooked arm 44 and a bottom hooked arm 46. The top hooked arm 44 and bottom hooked arm 46 of the second profile 14 have hooked ends 48 and 50 which are directed towards each other and positioned and sized to engage the hooked ends 30, 32 of the first profile hooked arms. Thus, the top hooked arm 44 has a downwardly oriented hooked end 48 which is engageable with the hooked end 30 of the top hooked arm 26 of the first profile 12 and the bottom hooked arm 46 has an upwardly oriented hooked end 50 which is engageable with the hooked end 32 of the bottom hooked arm 28 of the first profile 12. This two-arm configuration of the zipper 10 provides a relatively leak proof seal. The second profile 14 may also have an inwardly directed wedge or bump 52 which is located between the top hooked arm 44 and the bottom hooked arm 46 and aids in guiding the profiles into and out of engagement. The profile flanges 24, 42 provide a means by which the zipper may be guided in an automated bag making process, such as on a form-fill-seal machine, and also provide a means by which the zipper may be sealed to the bag 13.

Figure 3:
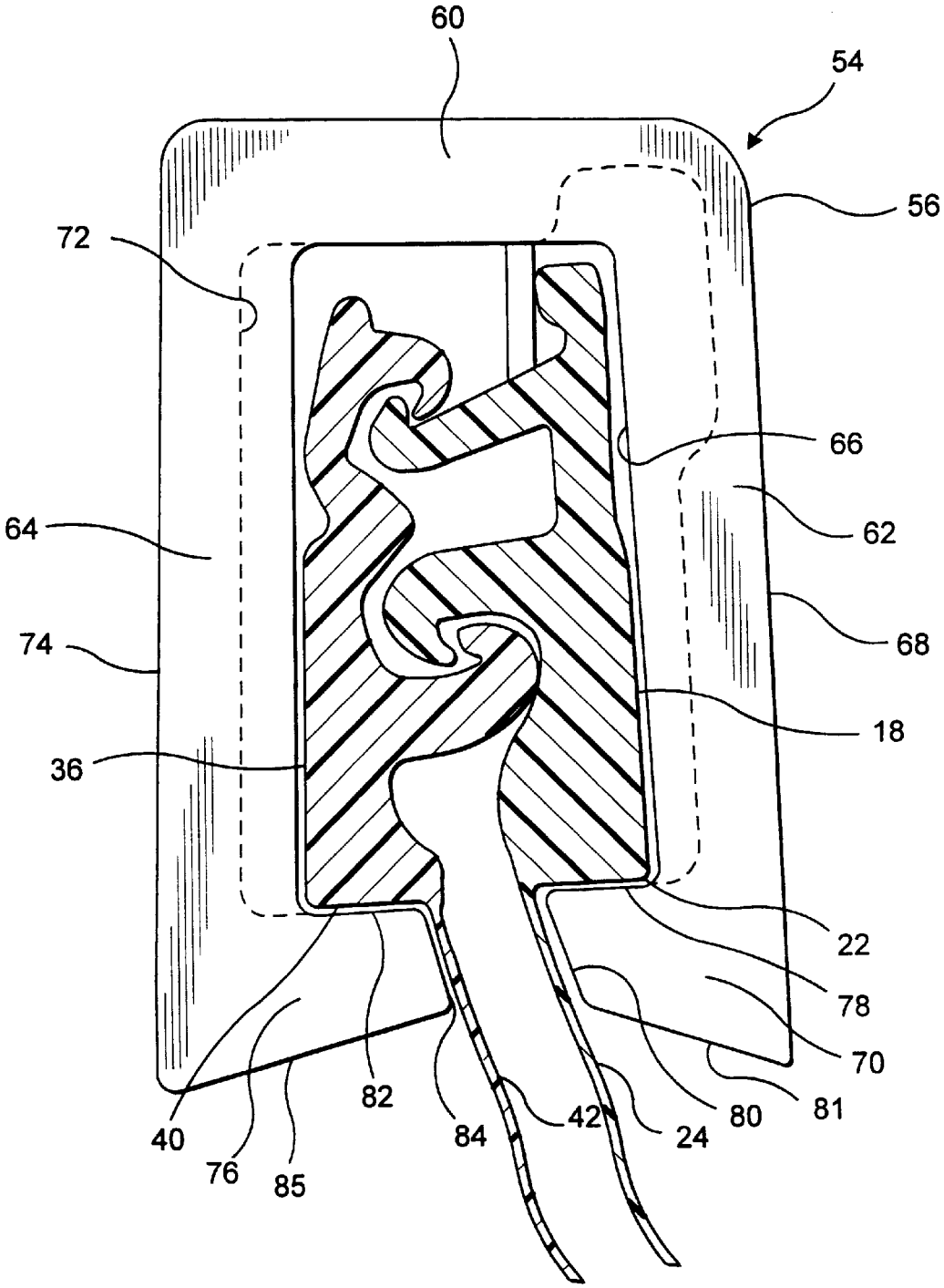
FIG. 3 is a cross sectional view of the closing end of the slider and zipper.
Figure 4:
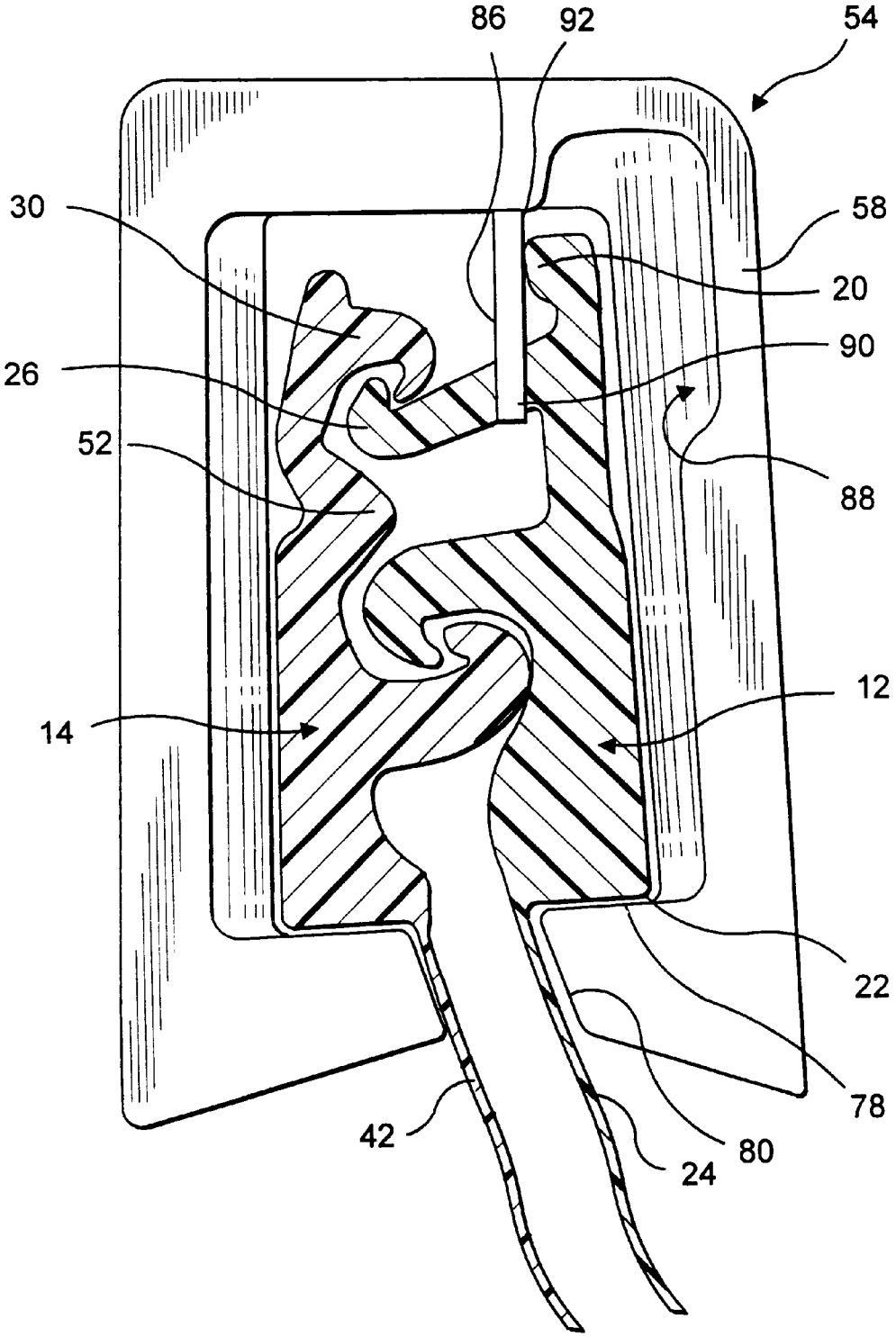
FIG. 4 is a cross sectional view of the opening end of the slider and zipper.

The slide zipper assembly is further provided with a slider 54 which slides along the mouth 11 of the bag 13 as shown in FIG. 2. FIGS. 3 and 4 show how the zipper 10 cooperates with the slider 54. Thus, the slider 54 has a closing end 56 and an opening end 58. As shown in FIG. 2, the slider 54 is slidable in an opening direction "O" in which the zipper profiles 12, 14 are disengaged by the slider, and a closing direction "C" in which the zipper profiles 12, 14 are engaged by the slider.

FIG. 3 shows the details of the closing end of the slider and FIG. 4 shows the details of the opening end of the slider. It should be understood that for purposes of clarity the zipper 10 and slider 54 in FIGS. 3 and 4 are shown with the same orientation. However, when one actually looks at the zipper from the closing end and the opening end the orientations of the zipper and slider will be reversed.

The slider 54 straddles the zipper 10 and is slidable along the zipper 10 in the closing and opening directions. The profiles are closed and sealed to each other at both ends to ensure that the zipper 10 does not become separated at its ends during use. In addition, the zipper 10 may be provided with a stopper at both ends which serves to prevent the slider from becoming disengaged from the zipper.

The slider 54 has a top portion 60, a first arm 62 and a second arm 64. The first arm 62 has an inner side 66, an outer side 68, and an inwardly directed bottom tab 70. Likewise, second arm 64 has an inner side 72, an outer side 74, and an inwardly directed bottom tab 76. The inner sides 66, 72 of the slider arms are tapered towards the closing end 56 so that at the closing end the arms are sufficiently close to press the profiles into engagement with each other.

The tab 70 of the first arm 62 has a tapered top surface 78, a side surface 80, and a tapered bottom surface 81. The tapered top surface 78 of the tab 70 mates with the bottom surface 22 of the first profile 12, imparting a generally upward force thereto. This force, as discussed below, plays a role in the opening and closing action of the slider 54.

The tab 76 of the second arm 64 likewise has a tapered top surface 82, a side surface 84, and a tapered bottom surface 85. The tapered top surface 82 mates with the bottom surface 40 of the second slider arm 64.

The mating of the profile bottom surfaces 22, 40 and the slider tab tapered top surfaces 78, 82 ensures that the slider 54 is securely positioned over the zipper 10 and reduces the possibility that the slider 54 will be pulled off the zipper 10. The slider tab tapered bottom surfaces 81, 85 facilitate insertion of the slider 54 over the zipper 10.

As is clear from FIG. 3, the zipper 10 is captured between the inner sides 66, 72 of the slider arms 62, 64 and between the two tabs 70, 76. The tabs 70, 76 cooperate with the slider top 60 to hold the slider 54 in place. The inner sides 66, 72 of the slider arms 62, 64 are sufficiently close at the closing end so that when the slider 54 is moved in the closing direction "C", the inner sides 66, 72 of the slider arms 62, 64 press against the outer sides 18, 36 of the first and second profiles 12, 14, thereby effecting engagement of the profiles 12, 14.

FIG. 4 shows the opening end 58 of the slider 54. At the opening end 58 the inner sides 66, 72 of the slider arms 62, 64 are sufficiently far apart so as to not impart a closing force to the profiles 12, 14. To this end, at the opening end 58 a separator blade 86 extends downwardly from the slider top as shown. In addition, the inner side 66 of first slider arm 62 is contoured to define a cavity 88 which extends upwardly into the top 60. The separator blade 86 is positioned so that when the slider 54 is moved in the opening direction, the separator blade 86 will deflect the top hooked arm 26 of the first profile 12 downwardly and out of engagement with the top hooked arm 30 of the second profile 14. A component of the force on the top hooked arm 26 of the first profile 12 will also direct the now disengaged profile 12 sideways and into cavity 88.

As the slider 54 is moved in the opening direction "O", the separator blade 86 deflects the top hooked arm 26 of the first profile 12 downwardly and out of engagement with the top hooked arm 30 of the second profile 14 until the top hooked arm 26 engages bump 52. The bump 52 provides a camming surface for the top hooked arm 26 as a component of the force exerted by the separator blade acts on the top hooked arm 26 to urge the first profile 12 away from the second profile 14. Simultaneously, the top surface 78 of the tab 70 pushes the bottom portion 22 of the first profile 12 upwardly. This upward deflection in combination with the outward deflection of the first profile 12 by the separator blade 86 disengages the bottom hooked arm 28 of the first profile 12 from the bottom hooked arm 46 of the second profile 14 and moves the first profile 12 up and into the cavity 88. Alternatively, means could be provided to force the second profile downwardly out of engagement with the first profile, as opposed to forcing the first profile upwardly or both upwardly and downwardly together.

Thus, the combined action of the separator blade 86 and first slider arm tab 70 on the first profile 12 serves to open the zipper as the slider is moved in the opening direction. Movement of the slider in the closing direction causes the slider arms to force the profiles into engagement.

Because of the attractiveness of slide zippers to consumers, it is commercially highly desirable to manufacture slider-zippered bags in a continuous automated process, such as on an FFS machine.

Figure 5:
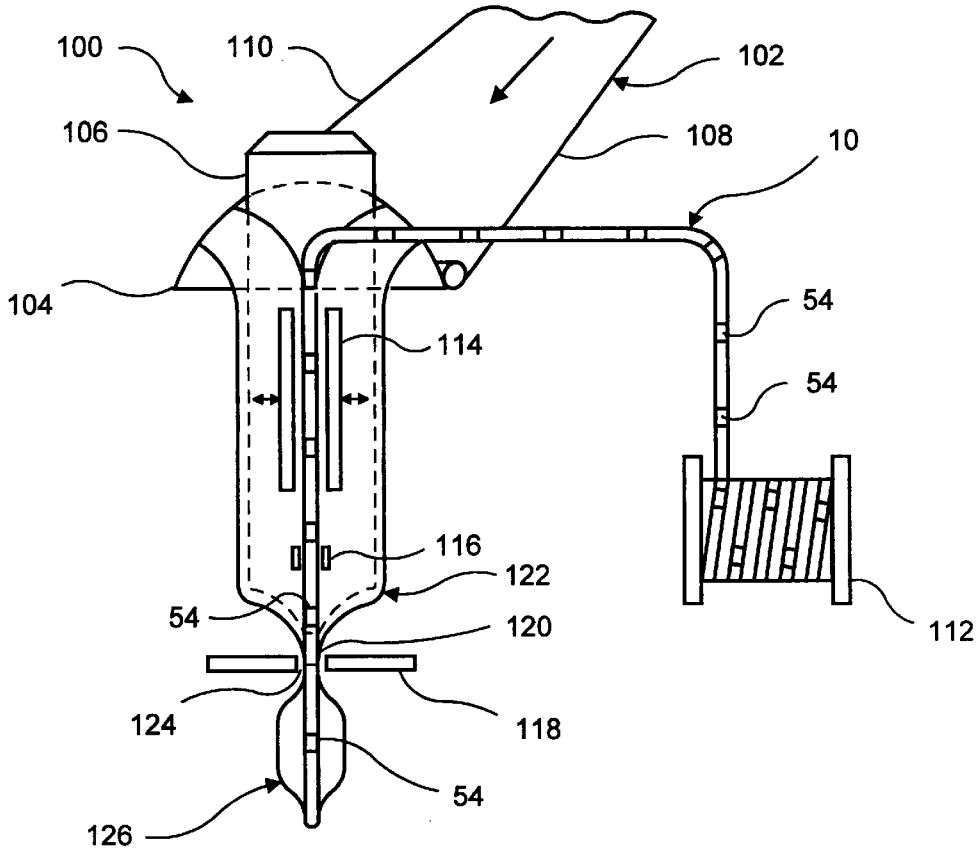
FIG. 5 shows an FFS machine adapted to make slide zippered bags according to a first embodiment of the present invention.
Figure 6:
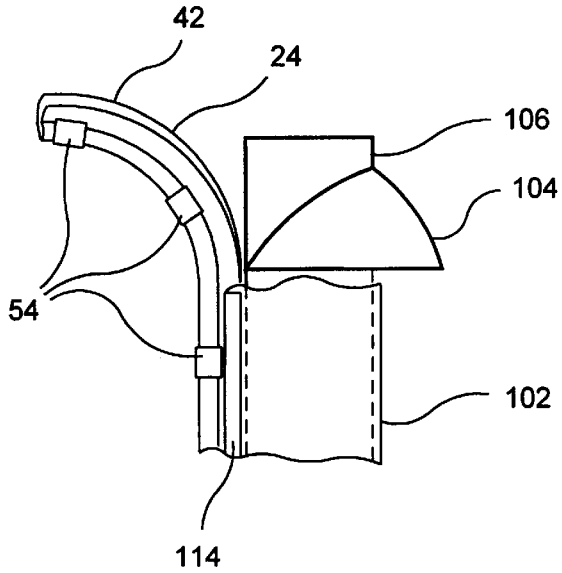
FIG. 6 shows a side view of the vertical seal bars of the FFS machine of FIG. 5 disposed to seal the zipper to the thermoplastic film.

FIG. 5 shows a bag being manufactured on an FFS machine 100 in accordance with a first embodiment of the present invention. Thermoplastic film 102 is fed from a continuous supply thereof into the FFS machine 100 and wrapped around a forming collar 104 and around a filling tube 106 to bring the longitudinal edges 108, 110 of the film 102 together to form a tube. The interlocked zipper 10 having sliders 54 preapplied thereto is fed from a continuous coil thereof 112 between the longitudinal edges 108, 110 of the film 102 as shown, after which vertical seal bars 114 seal the zipper flanges 24, 42 to the longitudinal film edges 108, 110 to form what will be the top of the bag. The sliders 54 must be clear of the vertical seal bars 114 such that the sliders 54 do not interfere in the sealing of the zipper 10 and are not crushed by the vertical seal bars 114, as shown in FIG. 6. It is thus critical that the zipper flanges 24, 42 be long enough to eliminate any interference between the sliders 54 and the vertical seal bars 114.

Figure 7:
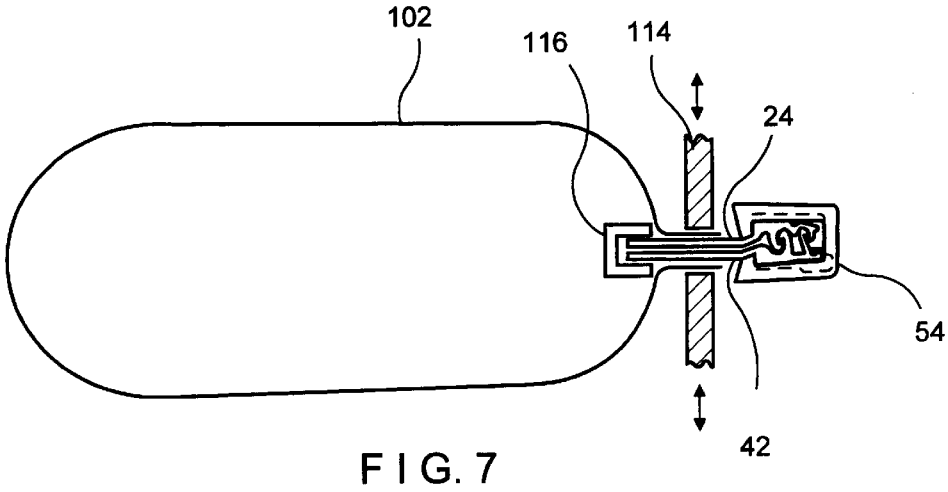
FIG. 7 shows a cross sectional view of the zipper guide and the vertical seal bars of the FFS machine of FIG. 5.

The zipper flanges 24, 42 also serve to allow the zipper 10 to be guided into the FFS machine 100 by zipper guide member 116, and thereby keep the zipper aligned with the edges of the film, as shown in FIG. 7, which shows a cross section of the zipper 10, the slider 54, the film 102, the vertical seal bars 114, and the zipper guide member 116.

Then, further downstream in the FFS machine 100 cross seal bars 118 form the sides of the bags by transversely sealing the tube of film. The cross seal bars 118 simultaneously seal the first side 120 of the bag 122 presently being made and seal the second side 124 of the preceding bag 126 (the first side seal of the preceding bag had previously been made), capturing a single slider between the two sides of the preceding bag 126, and cut the 126 preceding bag from the film 102. After the first side 120 is completed, the bag may be filled, if desired. Cross seal bars 118 may also seal the ends of the zipper 10 together to prevent the slider 54 from becoming detached therefrom. When the film 102 advances once again, the cross seal bars 118 complete the second side of the present bag, capturing a single slider between the two sides, and cut the present bag from the film and also complete the first side of the succeeding bag. In this manner slide-zippered bags are continuously made.

Figure 8:
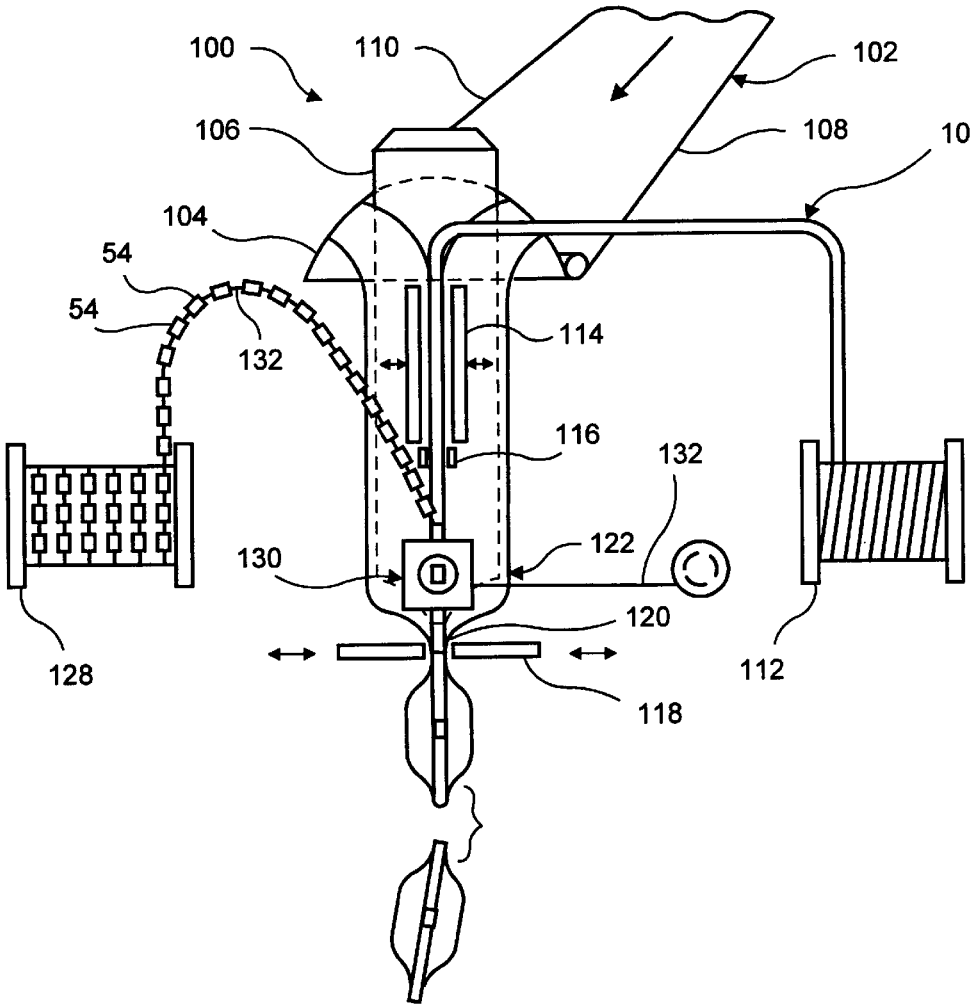
FIG. 8 shows an FFS machine adapted to make slide zippered bags according to a second embodiment of the present invention.

A second embodiment of the present is shown in FIG. 8. In this embodiment, as in the first embodiment as well as all other embodiments, the FFS machine 100 functions in the same manner. The difference with this embodiment from the first embodiment, however, is that the zipper 10 does not have the sliders 54 preapplied thereto. Rather, the sliders 54 are applied to the zipper after the zipper is sealed to the longitudinal edges 108, 110 of the film 102.

As shown in FIG. 8, the sliders are supplied from a continuous coil 128 to a slider insertor mechanism 130. Each slider 54 is connected to its adjacent slider via a connector 132. This connection may be achieved in any number of ways. For example, the sliders may be mechanically connected. Alternatively, the sliders may be connected by a carrier adhesive tape. Still alternatively, the sliders may be connected by a metal or plastic wire or molded together by a plastic "runner".

The connected sliders are fed into the slider insertor 130. As the film advances through the FFS machine and as bags are made, a slider 54 is removed from the connector 132 and applied to the zipper 10 of the bag 122 presently being made. The use of tapered bottom surfaces 81, 85 on the slider 54 facilitate this application. After the slider 54 is applied to the zipper 10, the connector scrap 132 exits the slider insertor 130 and the first side seal of the bag is made by the cross seal jaws 118. The bag is then completed as discussed above.

In a slight variation of this second embodiment, the slider insertor mechanism 130 can be positioned to apply the sliders 54 to the zipper 10 between the zipper roll 112 and the FFS machine 100.

Figure 9:
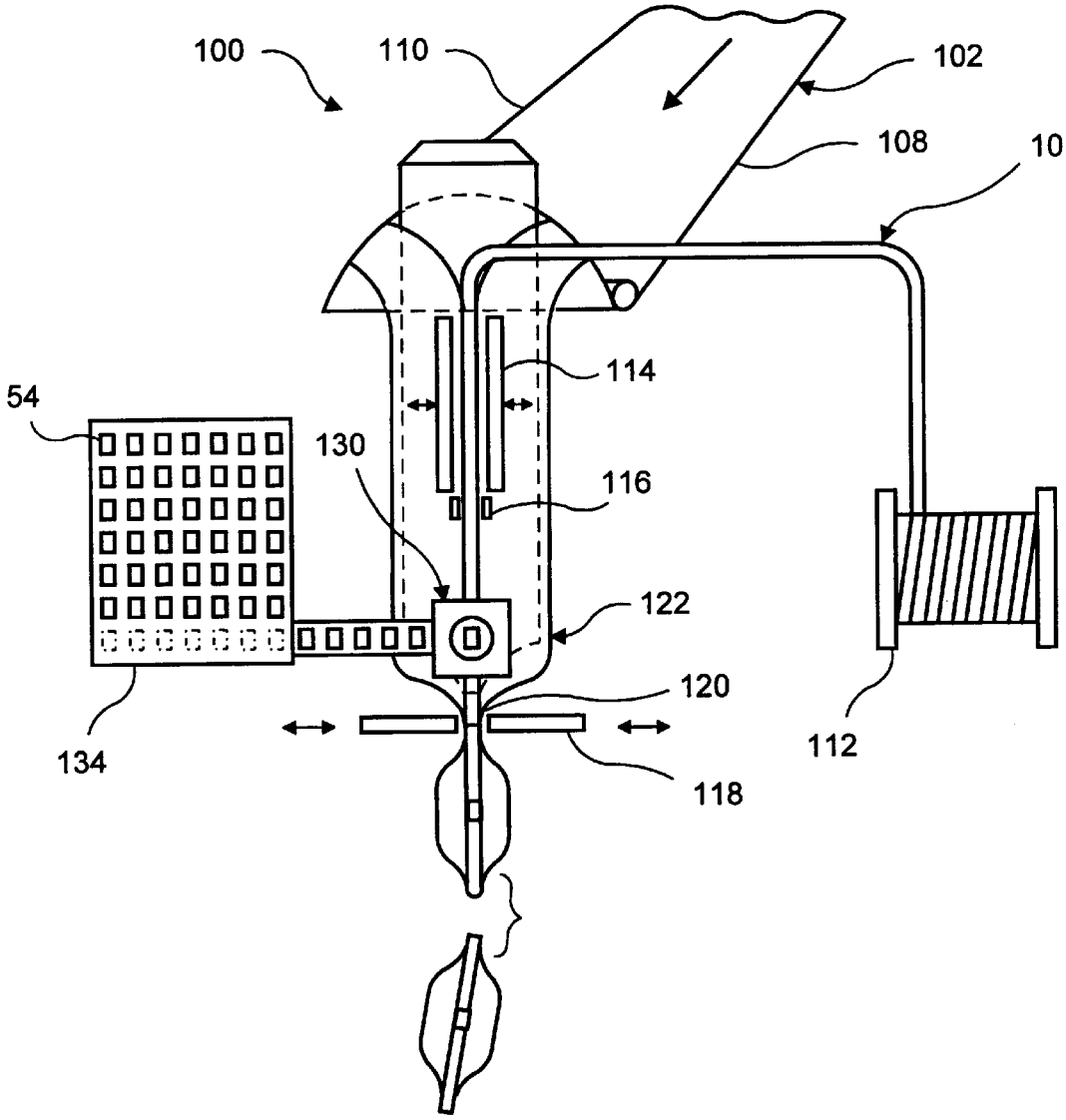
FIG. 9 shows an FFS machine adapted to make slide zippered bags according to a third embodiment of the present invention.
Figure 10:
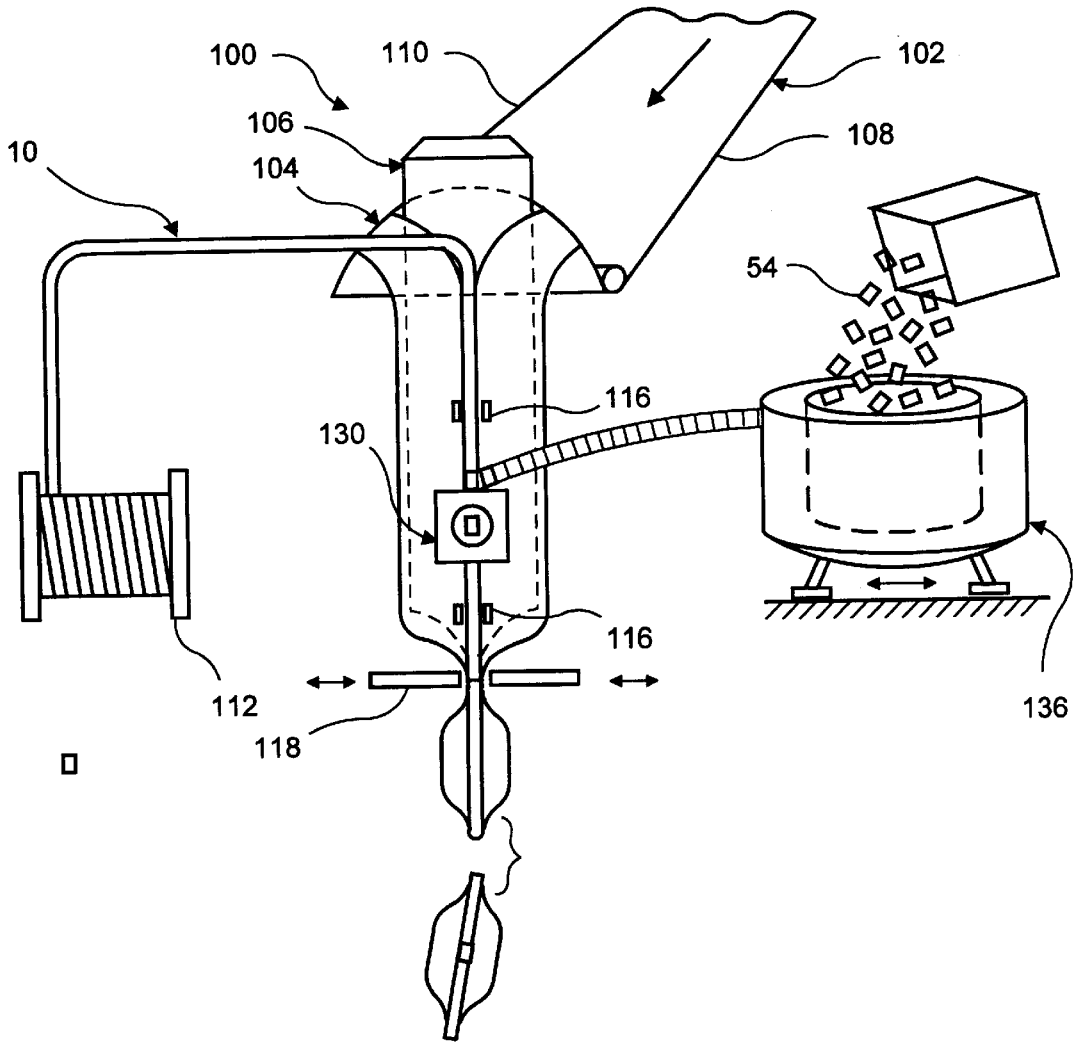
FIG. 10 shows an FFS machine adapted to make slide zippered bags according to a fourth embodiment of the present invention.

A third embodiment of the present invention is shown in FIG. 9. In this embodiment once again the zipper 10 is sliderless as it is sealed to the longitudinal edges 108, 110 of the film 102. A box magazine 134 of individual stacked sliders 54 is connected to the slider insertion mechanism 130. As the film 102 advances through the machine and as the zipper 10 is attached to the film, the sliders are automatically applied to the zippers of the individual bags by the insertor 130. The magazine is interchangeable with other magazines and may be replaced by another magazine when it becomes empty. Other types of commonly used magazines may also be employed, such as a coil type magazine wherein the sliders are attached to each other.

In a slight variation of this third embodiment, the slider insertor mechanism 130 can be positioned to apply the sliders 54 to the zipper 10 between the zipper roll 112 and the FFS machine 100.

In a fourth embodiment of the present invention, the zipper 10 is similarly sealed to the longitudinal edges 108, 110 of the film 102 without the sliders 54 being preapplied. Instead, a vibratory feeder bowl 136 is used to orient and deliver sliders 54 to the slider insertor 130. Bulk sliders 54 are loaded by the bag maker into the vibratory feeder bowl 136. The vibratory feeder bowl 136 then orients the sliders 54 and feeds them to the slider insertor 130, which then applies the sliders to the zippers. The vibratory feeder bowl 136 may vibrate in either a translational manner (back and forth) or in a rotational manner. Generally, when the FFS machine is running at a slow speed, such as less than 60 bags per minute, a translational device may be used. When faster speeds are desired, however, the rotational type of feeder bowl should be used to adequately provide for high speeds.

In a slight variation of this fourth embodiment, the slider insertor mechanism 130 can be positioned to apply the sliders 54 to the zipper 10 between the zipper roll 112 and the FFS machine 100.

Any of the foregoing embodiments may be used to make slide-zippered plastic bags on an FFS machine in a continuous, rapid manner. Modifications to the above would be obvious to those of ordinary skill in the art, but would not bring the invention so modified beyond the scope of the appended claims.

I claim:

1. A method of making reclosable bags on a form-fill-seal machine, said method comprising the steps of:

feeding a length of thermoplastic film into said form-fill seal machine, said thermoplastic film having opposite longitudinal edges;

folding said thermoplastic film over a forming collar and around a filling tube of said form-fill-seal machine to bring said longitudinal edges of said thermoplastic film in adjacent relationship to form a tube;

applying sliders at spaced intervals to a length of zipper, said zipper including two interlocking profiles, each of said profiles having an interlocking member interlockable with the interlocking member of the other profile and an integral flange having a portion extending beyond said sliders, feeding said length of zipper with said sliders applied into said tube;

sealing each of said integral flange portions of said profiles that extend beyond said sliders to said thermoplastic film;

cross-sealing said film tube to form a first side of a bag;

cross-sealing said film tube at a distance from said first side to form a second side of said bag so as to capture a single slider between said first and second sides; and cutting said bag from said film tube;

wherein each bag is provided with a zipper and a slider for opening and closing the zipper.

2. A method according to claim 1 wherein:

said zipper is fed between said longitudinal edges of said thermoplastic film;

one of said profiles is sealed to one of said edges; and the other of said profiles is sealed to the other of said edges.

3. A method according to claim 1 comprising the further step of guiding said zipper through said form-fill-seal machine by caputuring said profile flanges within a zipper guide.

4. A method according to claim 1 wherein said zipper profiles are interlocked when said zipper is fed into said tube.

5. An apparatus for making reclosable bags comprising:

means for supplying a length of thermoplastic film having opposite longitudinal edges;

means for folding said thermoplastic film into a tube so as to bring said longitudinal edges into adjacent relationship;

means for feeding a length of zipper having a plurality of sliders applied thereto into said tube, said zipper including two interlocking profiles, each of said profiles having an interlocking member interlockable with the interlocking member of the other profile and an integral flange having a portion extending beyond said sliders, said sliders being at spaced intervals with respect to each other;

means for sealing said integral flange portions of said profiles that extend beyond said sliders to said thermoplastic film;

means for cross-sealing said tube to form a first side of a bag;

means for cross-sealing said tube at a distance from said first side to form a second side of said bag so as to capture a single slider between said first and second sides; and means for cutting said bag from said tube;

wherein each bag will be provided with a zipper and a slider for opening and closing the zipper.

6. An apparatus according to claim 5 wherein:

said feeding means feeds said zipper between said longitudinal edges of said thermoplastic film;

said means for sealing each of said profiles seals one of said profiles to one of said edges; and said means for sealing each of said profiles seals the other of said profiles to the other of said edges.

7. An apparatus according to claim 5 further comprising means for guiding said zipper by said flanges.

8. An apparatus according to claim 5 wherein said sealing means seals said profile flanges to said thermoplastic film.

9. An apparatus according to claim 5 wherein said zipper profiles are interlocked when said zipper is fed into said tube.

* * * * *